US008189850B2

(12) United States Patent
Ono

(10) Patent No.: US 8,189,850 B2
(45) Date of Patent: May 29, 2012

(54) ULTRASONIC PROBE AND METHOD OF FABRICATION THEREOF

(75) Inventor: Akihiko Ono, Saitama (JP)

(73) Assignee: Nihon Dempa Kogyo Co., Ltd., Tokyo (JP)

( * ) Notice: Subject to any disclaimer, the term of this patent is extended or adjusted under 35 U.S.C. 154(b) by 1145 days.

(21) Appl. No.: 11/973,819

(22) Filed: Oct. 10, 2007

(65) Prior Publication Data

US 2008/0089538 A1 Apr. 17, 2008

(30) Foreign Application Priority Data

Oct. 13, 2006 (JP) ..... 2006-279452

(51) Int. Cl.
*H04R 25/00* (2006.01)
*H04R 31/00* (2006.01)

(52) U.S. Cl. ..... 381/426; 29/594

(58) Field of Classification Search ..... 381/426; 29/594

See application file for complete search history.

(56) References Cited

U.S. PATENT DOCUMENTS 3,946,422 A * 3/1976 Yagi et al. ..... 257/254
4,030,175 A * 6/1977 McShane ..... 29/25.35
4,283,649 A * 8/1981 Heinouchi ..... 310/324
4,439,642 A * 3/1984 Reynard ..... 310/309
4,755,975 A * 7/1988 Ito et al. ..... 367/140
5,481,153 A * 1/1996 Turner ..... 310/334
5,600,610 A * 2/1997 Hill et al. ..... 367/181
5,894,452 A * 4/1999 Ladabaum et al. ..... 367/163
6,771,785 B2 * 8/2004 Pompei ..... 381/191
6,775,388 B1 * 8/2004 Pompei ..... 381/191
6,865,140 B2 * 3/2005 Thomenius et al. ..... 367/155
7,292,696 B2 * 11/2007 Saeki et al. ..... 381/175

FOREIGN PATENT DOCUMENTS

JP 3-275044 12/1991
JP 5-44880 11/1993
JP 10-005227 1/1998

OTHER PUBLICATIONS

Office Action issued by Japanese Patent Office on Sep. 20, 2011 for the priority application No. JP2006-279452.

* cited by examiner

*Primary Examiner* — Elvin G Enad
*Assistant Examiner* — Alexander Talpalatskiy
(74) *Attorney, Agent, or Firm* — Scott D. Wofsy; Edwards Wildman Palmer LLP

(57) ABSTRACT

The present invention relates to a method of fabricating a convex type of ultrasonic probe in which a plurality of piezoelectric elements are arrayed on a backing material in an arc shape in a long axis thereof, an acoustic adjustment layer is provided on top of the piezoelectric element and resin is molded on two side surfaces along the long-axis direction, and an acoustic lens is attached over the acoustic adjustment layer with a chemical-resistant film therebetween, wherein the acoustic lens is attached after the chemical-resistant film has been affixed to cover the surface of the acoustic adjustment layer and at least two edge surfaces of the acoustic adjustment layer, the piezoelectric elements, and the backing material that are exposed in the long-axis direction.

4 Claims, 2 Drawing Sheets

ULTRASONIC PROBE AND METHOD OF FABRICATION THEREOF

FIELD OF THE INVENTION

The present invention relates to a method of fabricating a convex type of ultrasonic probe and, in particular, to a method of fabricating an ultrasonic probe in which a chemical-resistant film is affixed to the surface of an acoustic adjustment layer thereof.

BACKGROUND OF THE INVENTION

An ultrasonic probe is used as an ultrasonic transceiver in a ultrasonic diagnostic device for medical use, by way of example. One type thereof is a convex type of ultrasonic probe in which a plurality of piezoelectric elements are arrayed in an arc shape in the long-axis direction thereof, and this type of probe usually has an acoustic lens that curves in the short-axis direction, attached to the piezoelectric elements. Since such an ultrasonic probe will be soaked in an antiseptic solution when used for medical purposes, a chemical-resistant film is affixed to the inner periphery of the acoustic lens.

DESCRIPTION OF RELATED ART

A prior-art of an ultrasonic probe is shown in FIG. 2, where FIG. 2A is a section taken in the long-axis direction X thereof and FIG. 2B is a section taken in the short-axis direction Y thereof.

In the ultrasonic probe shown in FIG. 2, piezoelectric elements 2 are arrayed on a backing material 1 in the long-axis direction X (the widthwise direction of the piezoelectric elements 2), and the surface of the backing material 1 is formed in an arc shape and is affixed to a pedestal 3. Copper foil 4 is provided between the two edges sides of each piezoelectric element 2 and the backing material 1, and drive electrodes (not shown in the figures) on the lower sides of the piezoelectric elements 2 are lead out in a zigzag fashion. The copper foil 4 is connected by lead wires 7 to wiring circuitry (terminals) 6 of a printed circuit board 5 that is provided on each of two main surfaces of the backing material 1 in the long-axis direction X.

An acoustic adjustment layer 8 of, for example, a two-layer structure is provided over the piezoelectric elements 2 except for two end sides in the short-axis direction Y (in the lengthwise direction of the piezoelectric element 2). Wiring circuitry 9 is provided on those two end sides of the piezoelectric elements 2, connected in common to drive electrodes on the upper side thereof (not shown in the figures). The wiring circuitry 9 is connected to ground wires of the printed circuit boards 5. Resin 10 is molded over the two side surfaces in the long-axis direction X, from the acoustic adjustment layer 8 to the corresponding printed circuit board 5.

An acoustic lens 11 is attached to the acoustic adjustment layer 8. A chemical-resistant film 12 of a material such as a polyimide is affixed by adhesive to the inner periphery of the acoustic lens 11. A protruding portion of the acoustic lens 11 is exposed and housed in a case (not shown in the figures). (See Japanese Utility Model Publication No. 5-44880 and Japanese Patent Laid-Open Publication No. 3-275044.)

PROBLEMS WITH THE PRIOR ART

With the prior-art ultrasonic probe of the above described configuration, however , a problem occurs in that it becomes difficult to affix the chemical-resistant film 12 to the inner periphery of the acoustic lens 11 as the curvature of the convex arc-shaped structure increases (as the radius of curvature thereof decreases), such that the radius of curvature becomes less than 20 mm or the aperture angle exceeds 180 degrees, by way of example. If defects such as air bubbles occur between the inner periphery of the acoustic lens 11 and the film 12, because of faults such as wrinkles in the chemical-resistant film 12, the ultrasonic waves will be greatly attenuated so that the probe can no longer function and it thus becomes a defective product.

OBJECTIVE OF THE INVENTION

An objective of the present invention is to provide a method of fabricating a convex type of ultrasonic probe in which the chemical-resistant film can be affixed simply.

SUMMARY OF THE INVENTION

The present invention relates to a method of fabricating a convex type of ultrasonic probe in which a plurality of piezoelectric elements are arrayed on a backing material in an arc shape in a long-axis direction thereof; an acoustic adjustment layer is provided on top of the piezoelectric element and resin is molded on two side surfaces along the long-axis direction; and an acoustic lens is attached over the acoustic adjustment layer with a chemical-resistant film therebetween; wherein the acoustic lens is attached from above the acoustic adjustment layer after the chemical-resistant film has been affixed to cover the surface of the acoustic adjustment layer and at least two edge surfaces of the acoustic adjustment layer, the piezoelectric elements, and the backing material that are exposed in the long-axis direction.

EFFECTS OF THE INVENTION

With the above-described method of fabricating an ultrasonic probe in accordance with the present invention, the chemical-resistant film is affixed over the acoustic adjustment layer that has a protruberant surface due to the convex shape, so that the task of affixing the film is simpler than a configuration in which the film is affixed to the inner periphery of the acoustic lens, as in the prior art. This task is particularly simplified when the two edge surfaces in the long-axis direction are provided with folded-back portions. In addition, components such as the acoustic adjustment layer and the backing material that are exposed on the two edge surfaces of the probe body are covered thereby and the chemical-resistant film is affixed by an epoxy resin adhesive material (chemical resistant), so that chemicals can be prevented from penetrating from the two edge surfaces of the ultrasonic probe.

In addition, the present invention ensures that the chemical-resistant film is affixed over the surface of the acoustic adjustment layer and the entire outer periphery comprising two side surfaces in the long-axis direction and the two edge surfaces. Since this ensures that the chemical-resistant film is also affixed over the resin molding on the two side surfaces of the probe, the entire outer periphery is protected from chemicals. Note that since the above-described two side surfaces are molded in resin, penetration from the two edge surfaces thereof is also reduced.

BRIEF DESCRIPTION OF THE DRAWINGS

FIG. 1 is illustrative of an embodiment of the ultrasonic probe of the present invention, where FIG. 2 is illustrative of a prior-art of an ultrasonic probe, where

DETAILED DESCRIPTION OF PREFERRED EMBODYING EXAMPLE

Figure 1A:
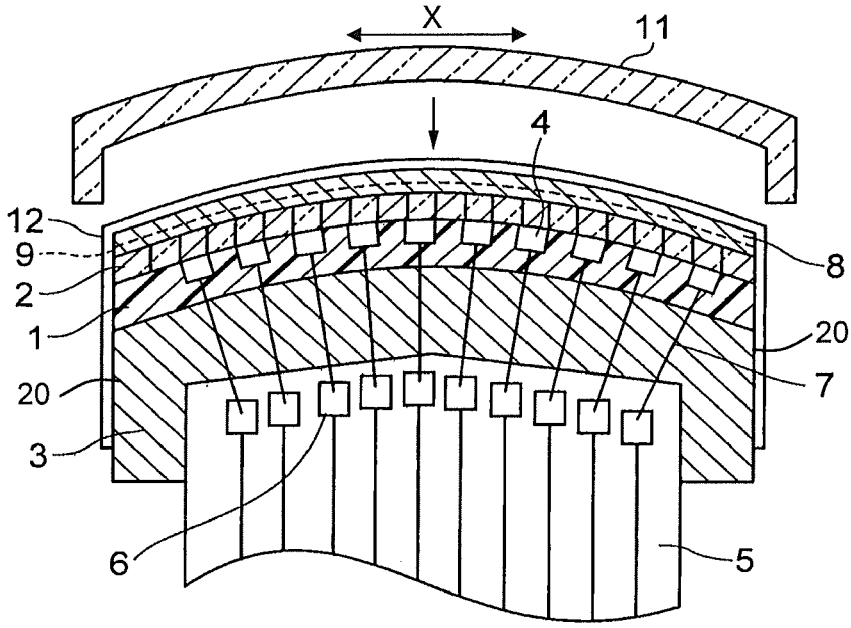
FIG. 1A is a section taken in the long-axis direction thereof and FIG. 1B is a section taken in the short-axis direction thereof.
Figure 1B:
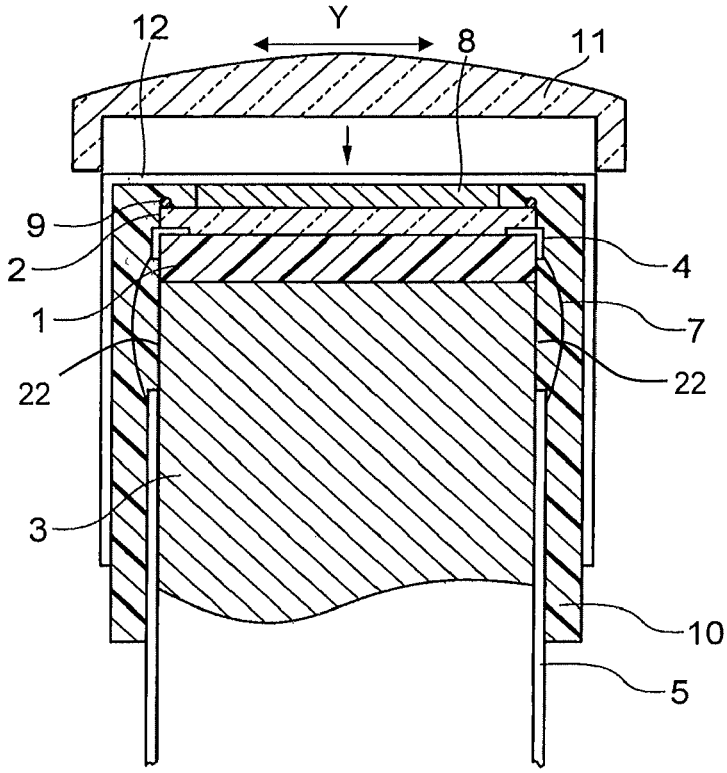
Figure 2A:
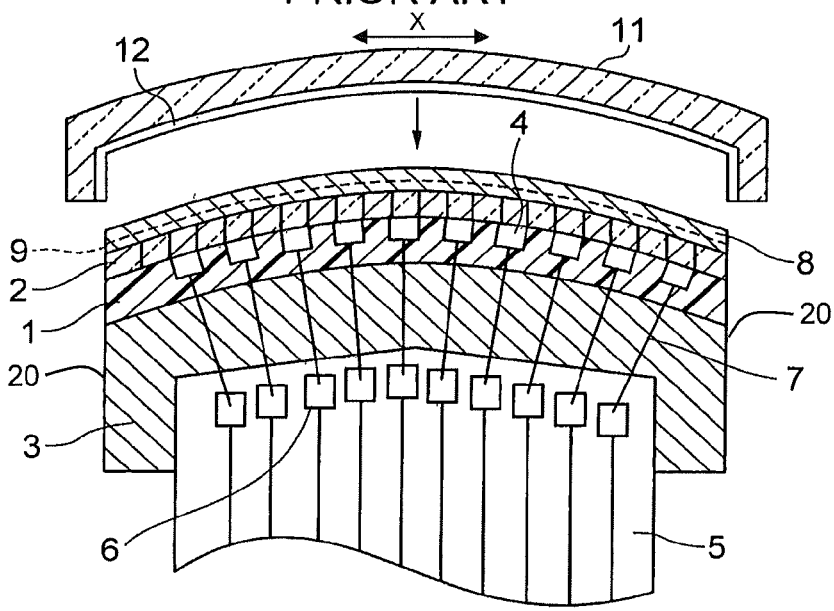
FIG. 2A PRIOR ART
FIG. 2A is a section taken in the long-axis direction thereof and FIG. 2B is a section taken in the short-axis direction thereof.
Figure 2B:
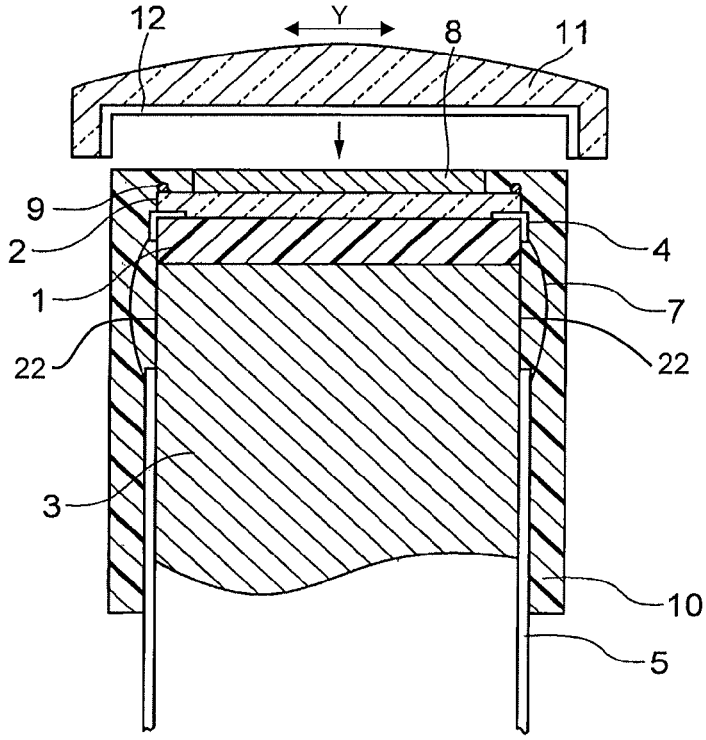
FIG. 2B PRIOR ART

An embodiment of an ultrasonic probe in accordance with the present invention is shown in FIG. 1, where FIG. 1A is a section taken in the long-axis direction X thereof and FIG. 1B is a section taken in the short-axis direction Y thereof. Note that portions that are the same as those of the prior art are denoted by the same reference numbers, and further description thereof is either abbreviated or omitted.

In the ultrasonic probe of the present invention, a piezoelectric plate (piezoelectric elements) is affixed onto the backing material 1, then the two-layer acoustic adjustment layer 8 is formed. The acoustic adjustment layer 8 is formed to avoid the two sides of the piezoelectric plate 2 in the short-axis direction Y. In this case, the copper foil 4 is interposed between the two sides of the piezoelectric plate 2 in the short-axis direction Y and the backing material 1. Cuts are then made from the acoustic adjustment layer 8 as far as the backing material 1, to divide the piezoelectric plate into piezoelectric elements 2. This produces a plurality of the piezoelectric elements 2 that are arrayed in the long-axis direction X. In this case, the copper foil 4 is led out alternately from the two end sides of the piezoelectric elements 2.

The surface of the backing material 1 is then affixed to the arc-shaped pedestal 3. This causes the plurality of piezoelectric elements 2 to be disposed over a curved surface, making them convex. Wiring circuitry 6 of printed circuit boards 5 that are connected to the two side surfaces of the backing material 1 and the pedestal 3 in the long-axis direction X are then connected to the copper foil 4 by lead wires 7. A resin mold 10 is formed on the two side surfaces 22 (FIG. 1B) in the long-axis direction X (FIG. 1A), to cover parts of the acoustic adjustment layer 8, the piezoelectric elements 2, the copper foil 4, and the printed circuit boards 5.

A chemical-resistant film 12 is then affixed by an adhesive over the acoustic adjustment layer 8. In this case, the film 12 extends over the surface of the acoustic adjustment layer 8. In this case, the film 12 extends over the surface of the acoustic adjustment layer 8 as well as the acoustic adjustment layer 8, the piezoelectric element 2, and the backing material 1 that are exposed on the two edge surfaces 20 in the long-axis direction X, avoiding the lower end portion of the resin mold 10 that is exposed in the long-axis direction X. Finally, the acoustic lens 11 is attached over the acoustic adjustment layer 8. This exposes the protruding portion of the acoustic lens 11, which is housed in a case (not shown in the figures).

In the thus-configured method of fabricating an ultrasonic probe in accordance with the present invention, since the chemical-resistant film 12 is affixed from above the acoustic adjustment layer 8 that has a convex protruberant surface, the work of affixing the same is simpler in comparison with the way in which the film is affixed to the inner periphery of the acoustic lens 11 as in the prior-art. There are therefore no problems such as air bubbles between the acoustic adjustment layer 8 and the film 12, created by wrinkles or the like, so that the ultrasonic characteristics of the ultrasonic probe are favorably maintained.

Since the chemical-resistant film 12 is also affixed onto the two edge surfaces 20 in the long-axis direction X of the ultrasonic probe, chemicals are prevented from penetrating, particularly from the acoustic adjustment layer 8 and the backing material 1 that are exposed on the two edge surfaces 20. In addition, since the film 12 is also affixed onto the resin mold 10, the chemical resistance can be further reinforced.

What is claimed is:

1. A method of fabricating an ultrasonic probe defining a longitudinal axis in which a plurality of piezoelectric elements are arrayed on a backing material in an arc shape in a long-axis direction thereof extending substantially orthogonal to the longitudinal axis; an acoustic adjustment layer is provided on top of said piezoelectric element and resin is molded on two side surfaces of said plurality of piezoelectric elements, said backing material, and said acoustic adjustment layer along said long-axis direction; and an acoustic lens is attached over said acoustic adjustment layer with a chemical-resistant film therebetween, wherein said acoustic lens is attached after said chemical-resistant film has been affixed to cover the surface of said acoustic adjustment layer and at least two edge surfaces of said acoustic adjustment layer, said piezoelectric elements, and said backing material that are exposed in said long-axis direction and extends along the longitudinal axis, and wherein a portion of said chemical-resistant film is exposed relative to said lens and extends along the longitudinal axis after attachment of said lens.

2. The method of fabricating an ultrasonic probe according to claim 1, wherein said chemical-resistant film is also affixed over said two side surfaces of said plurality of piezoelectric elements, said backing material, and said acoustic adjustment layer in said long-axis direction.

3. The method of fabricating an ultrasonic probe according to claim 1, wherein said chemical-resistant film is also affixed over said resin.

4. A convex type of ultrasonic probe defining a longitudinal axis in which a plurality of piezoelectric elements are arrayed on a backing material in an arc shape in a long-axis direction thereof extending substantially orthogonal to the longitudinal axis; an acoustic adjustment layer is provided on top of said piezoelectric element and resin is molded on two side surfaces of said plurality of piezoelectric elements, said backing material and said acoustic adjustment layer along said long-axis direction; and an acoustic lens is attached over said acoustic adjustment layer with a chemical-resistant film therebetween, wherein said chemical-resistant film covers the surface of said acoustic adjustment layer and at least two edge surfaces of said acoustic adjustment layer, said piezoelectric elements, and said backing material that are exposed in said long-axis direction and extend along the longitudinal axis, and wherein a portion of said chemical-resistant film is exposed relative to said lens and extends along the longitudinal axis.

* * * * *